United States Patent [19]

Yamamoto et al.

[11] 4,080,118

[45] Mar. 21, 1978

[54] ROTARY PISTON ENGINE WITH SEALS AND GAS GROOVE MEANS IN THE ROTOR END FACES

[75] Inventors: Kenichi Yamamoto, Hiroshima; Noriyuki Kurio, Higashi Hiroshima, both of Japan

[73] Assignee: Toyo Kogyo Co., Ltd., Japan

[21] Appl. No.: 683,220

[22] Filed: May 4, 1976

[30] Foreign Application Priority Data

May 14, 1975 Japan ..... 50-65391[U]

[51] Int. Cl.[2] ..... F01C 19/08; F02B 55/02

[52] U.S. Cl. ..... 418/77; 418/81; 418/142

[58] Field of Search ..... 418/61 A, 75, 77, 81, 418/142; 123/8.01; 277/81 P

[56] References Cited

U.S. PATENT DOCUMENTS

| | | | |
|---|---|---|---|
| 3,261,542 | 7/1966 | Jones | 418/61 A |
| 3,447,512 | 6/1969 | Winkelmann et al. | 123/8.05 |
| 3,891,357 | 6/1975 | Davis et al. | 418/142 |

FOREIGN PATENT DOCUMENTS

| | | | |
|---|---|---|---|
| 967,040 | 8/1964 | United Kingdom | 418/142 |

*Primary Examiner*—John J. Vrablik

*Attorney, Agent, or Firm*—Wenderoth, Lind & Ponack

[57] ABSTRACT

A rotary piston engine has a housing structure which includes a peripheral wall, having a trochoidal inner surface, and end walls secured to the peripheral wall with the latter situated therebetween. A rotor, having each end face formed with at least one set of side seal grooves and at least one oil seal groove, is housed within the housing structure for planetary motion. For avoiding leakage of blowby gas from any one of working chambers defined between the rotor flanks and the trochoidal inner surface into the inside of an oil seal in the oil seal groove past side seals in the side seal grooves, an annular gas groove is formed on at least one end face of the rotor. This annular gas groove is communicated to the oil seal groove by means of a passage formed in a partition wall separating the gas groove from the oil seal groove. The blowby gas collected in the gas groove can be recovered in the intake chamber through an intake port, provided in eitheror both of the end walls, during the planetary motion of the rotor.

14 Claims, 7 Drawing Figures

ROTARY PISTON ENGINE WITH SEALS AND GAS GROOVE MEANS IN THE ROTOR END FACES

BACKGROUND OF THE INVENTION

The present invention generally relates to a rotary piston engine and, more particularly, to a gas sealing mechanism in a rotary piston engine.

A typical rotary piston engine has a peripheral wall, having a trochoidal inner surface, and axially spaced end walls interconnected to each other with said peripheral wall positioned therebetween, thereby defining an engine cavity in said housing structure. A substantially triangular rotor having arcuate flanks and apex portions equal in number to said flanks is rotatably mounted within the engine cavity on an eccentric portion of a power output shaft, journalled in the end walls, for eccentric rotation about the shaft. The rotor within the engine cavity divides said engine cavity into a plurality of working chambers which vary in volume during the planetary motion of said rotor with said apex portions held in sliding engagement with the trochoidal inner surface of the peripheral wall through corresponding apex seals. In each of these working chambers there takes place a four cycle internal combustion process which includes intake, compression, combustion and exhaust strokes. An air-fuel mixture is adapted to be introduced into one of the working chambers during the intake stroke through an intake port formed in one or both of the end walls. The rotor is generally cooled by oil flowing through the power output shaft and then the eccentric portion thereof, a controlled amount of which is allowed to leak into a definite area within a space between end faces of the rotor and the end walls for the purpose of lubrication.

In the rotary piston engine of the construction described above, it is also well known that, in order to block the path of leakage of gas from any one of the working chambers into the space between the end faces of the rotor and the end walls and also the path of leakage of oil from the eccentric portion of the shaft into the same space, sealing means are employed on each end face of the rotor.

More specifically, the rotor has in each end face at least one set of side seal grooves, each extending so as to follow the curvature of the rotor flank, and also at least one oil seal groove in coaxial relation to the eccentric portion of the power output shaft and situated inside the side seal grooves. Each of the side seal grooves accommodates therein a side seal and a spring element, such as a corrugated wire spring, for outwardly biasing the side seal to cause the latter to slidingly engage the corresponding end wall, while the opposed end portions of the side seal are operatively engaged with two of the corner seals which also receive one end of the apex seals on the respective apex portions of the rotor. Similarly, the oil seal groove accommodates therein an oil seal ring and a spring element for outwardly biasing the oil seal ring to cause the latter to slidingly engage the corresponding end wall and which is held in position by a so-called O-ring, that is, a retainer ring which serves not only to retain the oil seal ring in position, but also to make a contribution to oil sealing.

In practice, a blowby gas, which is at an elevated temperature and containing unburned fuel components of the combustion gas which, when they accumulate, tend to form sludge which sticks to the engine parts which are exposed to the passage of the blowby gas, tends to enter past the side seals into the space under the influence of the explosive force developed upon combustion of the air-fuel mixture within the working chamber during the combustion stroke. When the rotary piston engine has been operated for a relatively great total period of time, the blowby gas causes a noticeable adverse influence on the engine parts and particularly on the O-ring, which is made of elastic rubber material, and bearing elements forming the bearing mechanism by which the rotor is mounted on the eccentric portion of the power output shaft. In other words, the O-ring tends to deteriorate under the influence of the elevated temperature of the blowby gas and the contact with the unburned fuel components while the oil seal ring and the bearing elements tend to be damaged by the sludge sticking thereto.

In order to minimize the adverse influence of the blowby gas on the engine parts, for example, Japanese Patent Publication (Unexamined) No. 10909/1975 which has been laid open to public inspection discloses the provision of gas groove means formed in the rotor on each end face thereof and between the side seals and the oil seal ring so that the blowby gas having entered the space past the side seals can be trapped, or otherwise collected, in said gas groove means. With the gas groove means such as disclosed in the publication referred to above, the adverse influence of the blowby gas on the engine parts can be minimized to a certain extent. However, there is still room for improvement in minimizing such adverse influence.

BRIEF SUMMARY OF THE INVENTION

The present invention is intended to provide an improved rotary piston engine wherein there is formed gas groove means in the rotor on at least one of the rotor end faces and substantially intermediate the side seals and the oil seal ring, said gas groove means being so designed as to substantially eliminate the disadvantages and inconveniences inherent in the prior art engine of a similar kind.

Another object of the present invention is to provide an improved rotary piston engine of the type referred to above wherein measures are taken to substantially avoid deterioration of the oil seal ring, which may otherwise occur under the influence of the blowby gas, which brings about a consequent improvement in the oil consumption of the engine.

According to one aspect of the present invention, the gas groove means is in the form of an endless groove formed in the rotor end face radially outwardly of the oil seal groove and in spaced relation to said oil seal groove. The oil seal groove and the gas groove are spaced from each other by an axially extending annular partition wall and are communicated with each other by passage means formed in said annular partition wall. The partition wall has a radially inner surface contiguous to the wall defining the oil seal groove and a radially outer surface contiguous to the wall defining the gas groove, one of the axial ends of said partition wall being integral with the body of the rotor while the other of the axial ends of the partition wall extends axially outwardly and terminates axially rearwardly of the plane of the rotor end face. The passage means formed in the partition wall can be constituted by a space defined between the plane of the rotor end face and said other of said ends of the partition wall.

According to another aspect of the present invention, when the other of the opposed ends of the partition wall terminates flush with the plane of the rotor end face, the passage means can be constituted by a plurality of bores radially extending completely through the thickness of the partition wall.

In any event, by so constructing the rotary piston engine, the blowby gas which has entered into the space between the rotor end face and the adjacent end wall past the side seals under pressure is caused to enter the gas groove means and, therefore, is decelerated. Therefore, with the blowby gas decelerated, a major portion of said blowby gas can be blocked from further leaking past the oil seal into the bearing mechanism so that the blowby gas will not cause any substantial adverse influence on the oil seal ring and the bearing elements of the rotor bearing mechanism. It is to be noted that that portion of the blowby gas blocked in the gas groove means is subsequently sucked into one of the working chambers during the intake stroke to admix with a fresh air-fuel mixture, introduced into the intake chamber, under the influence of a negative pressure developed to draw such fresh air-fuel mixture into the intake chamber through the intake port in the end wall.

BRIEF DESCRIPTION OF THE DRAWING

These and other objects and features of the present invention will readily become apparent from the following description taken in conjunction with preferred embodiments thereof with reference to the accompanying drawings, in which.

DETAILED DESCRIPTION OF THE INVENTION

Figure 1:
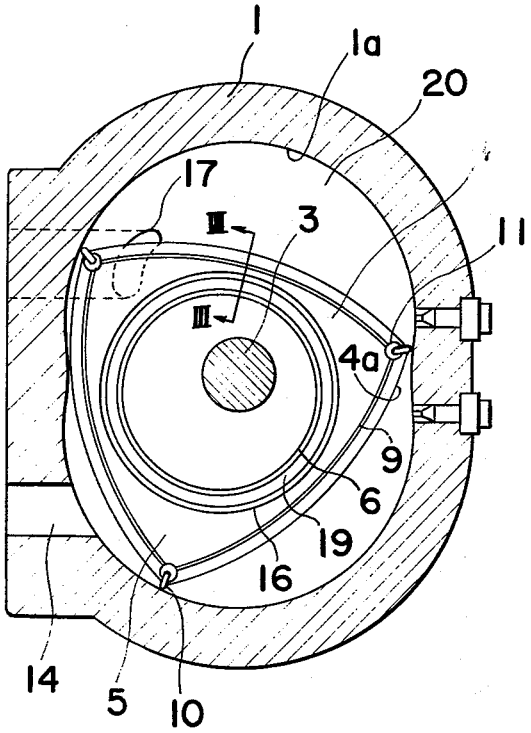
FIG. 1 is a sectional view of a rotary piston engine, which is taken transversely of the longitudinal axis of such rotary piston engine.

Before the description of the present invention proceeds, it is to be noted that like parts are designated by like reference numerals throughout the accompanying drawings.

Figure 2:
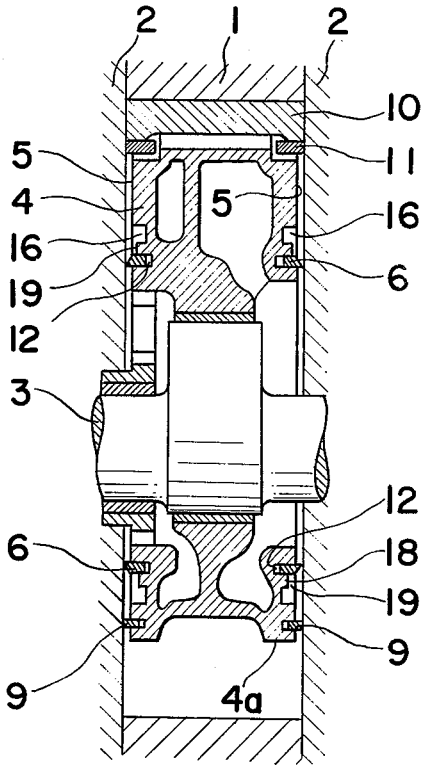
FIG. 2 is a longitudinal sectional view of the rotary piston engine embodying the present invention.
Figure 3:
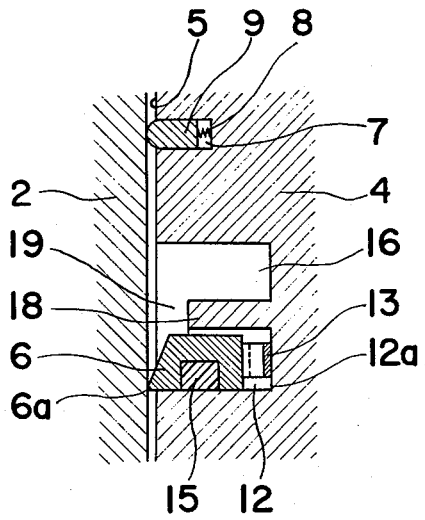
FIG. 3 is a cross sectional view, on an enlarged scale, of a portion of the engine, taken along the line III—III in FIG. 1.

Referring first to FIGS. 1 to 3, there is illustrated a rotary piston engine comprising a housing structure which includes a peripheral wall 1, having a trochoidal inner surface 1*a* and an exhaust port 14, and axial end walls 2 secured to respective ends of said peripheral wall 1, one or both of said end walls 2 having an intake port 17 defined therein. A multi-sided, for example, triangular, rotor 4 having apex portions operatively carrying respective apex seals 10 is mounted on an eccentric shaft 3 within the housing structure for planetary rotation, said apex portions being held in sliding engagement with said trochoidal inner surface 1*a* through the apex seals 10 during the planetary motion of the rotor 4.

The rotor 4 has each end face 5 facing the associated end wall 2 in parallel relation thereto and in each end wall is at least one set of side seal grooves 7, which extend in parallel relation to, that is, so as to follow the curvature of respective rotor flanks 4*a* of the rotor 4, and also at least one oil seal groove 12 coaxial with the center of the rotor end face 5 or the longitudinal axis of that eccentric portion of the eccentric shaft 3 on which the rotor 4 is rotatably mounted.

Side seals 9 are operatively accommodated within the side seal grooves 7, respectively, and outwardly biased by spring elements 8, such as corrugated wire springs, to cause said respective side seals 9 to be held in sliding engagement with the adjacent end wall 2, which spring elements 8 are held in position within the respective side seal grooves 7 between the side seals 9 and the bottom of the side seal grooves 7. Each of the opposed ends of any of the side seals 9 is operatively engaged with a corner seal 11 which also receives one end of the associated apex seal 10. Similarly, a ring-shaped oil seal 6 having a radially inwardly facing recess and a lip 6*a* formed at one end thereof is operatively accommodated within the oil seal groove 12 and is outwardly biased by a spring element 13 to cause said lip 6*a* on said oil seal 6 to be held in sliding engagement with the adjacent end wall 2, which spring element 13 is held in position within the oil seal groove 12 between the oil seal 6 and the bottom of said oil seal groove 12. An O-ring 15 is also accommodated within the oil seal groove 12 and retained in position within the radially inwardly facing recess in said oil seal 6.

The side seals 9 on each rotor end face 5 of the rotor 4 prevent gaseous medium from leaking into a space between the adjacent end wall 2 and the rotor end face 5 while the oil seal 6 prevents lubricant oil from leaking into the same space.

The rotary piston engine of the above construction and its operation are well known to those skilled in the art and, therefore, further details thereof are herein omitted for the sake of brevity. However, it is to be noted that, so far as the application of the present invention is involved, the number of side seal grooves 7 together with the associated side seals 9 and the number of the oil seal grooves 12 together with the associated oil seals 6 may not be always limited to one. Moreover, the exhaust port 14 may be present in one or both of the end walls 2, but is preferably in the peripheral wall 1 as shown.

According to an essential feature of the present invention, gas groove means for collecting blowby gas which has leaked into the space past the side seals 9 is provided in at least one of the opposite end faces 5 of the rotor 4. In the illustrated embodiment of FIGS. 1 to 3, and particularly in FIGS. 2 and 3, the gas groove means is shown as being provided on each end face 5 of the rotor 4.

The gas groove means comprises an annular gas chamber 16 in each of the end faces 5 of the rotor 4 at a position substantially intermediate the side seals 9 and the oil seals 6. The annular gas chamber 16 and the oil seal groove 12 are spaced from each other by an annular partition wall 18, which axially projects towards the adjacent end wall 2 of the engine housing structure, but are communicated with each other through passage means which will now be described.

The passage means in the embodiment of FIGS. 1 to 3 is in the form of an annular cutout portion 19 constituted by making the partition wall 18 terminate short of the plane flush with the rotor end face 5. In other words, when the axially outer annular end face of the partition wall 18 is, as best shown in FIG. 3, spaced from the plane flush with the rotor end face 5 a predetermined distance smaller than the depth of the gas chamber 16 as measured from the plane flush with said rotor end face 5 to the bottom of the gas chamber 16, the difference between the depth of the gas chamber and the height of the partition wall defines the annular cut-out portion 19.

Preferably, the annular gas chamber 16 is in the vicinity of and in coaxial relation to the oil seal groove 12 so that, during the planetary motion of the rotor, the gas chamber 16 and/or the passage means can pass over the intake port 17 at local areas thereof.

In the construction as hereinbefore described, it is clear that substantially all the blowby gas having leaked under pressure past the side seals 9 into the space between the rotor end face 5 and the adjacent end wall 2 can be collected and decelerated therein. Therefore, the blowby gas thus leaked does not cause any substantial adverse influence either on the oil seal 6 and the O-ring 15, or the bearing elements of the bearing mechanism by which the rotor 4 is mounted on the eccentric shaft 3. The blowby gas collected in the gas chamber 16 is, when any one of the side seals 9 comes into a position to bridge the intake port 17 during the planetary motion of the rotor 4, sucked into one of the working chambers 20 during the intake stroke by the effect of a negative pressure developed to draw an air-fuel mixture into the intake chamber through the intake port 17. Even if part of the blowby gas in the gas chamber 16 flows into the oil seal groove 12 and into the portion, as at 12*a*, rearwardly of the oil seal 6, that portion of the blowby gas within that portion 12*a* of the oil seal groove 12 can also be recovered and caused to into the intake chamber through the passage means. However, a more preferrable result can be achieved if the gas chamber 16 is so positioned and/or so shaped that, during the planetary rotation of the rotor 4, a portion of the gas chamber 16 momentarily bridges the intake port 17, thereby communicating the chamber 16 with the intake chamber through the intake port 17.

Furthermore, the gas chamber 16 and the passage means constituted by the annular cutout portion 19 serve as a thermal insulator so that heat transmission from the combustion chamber towards the oil seal 6 through the body of the rotor 4 can advantageously be minimized, thereby protecting the oil seal 6 and the O-ring 15 from being adversely affected by the heat. In addition, since the contact area between the oil seal 6 and the partition wall 18 is minimized by the presence of the annular cutout portion 19 forming the passage means, heat transmission from the partition wall 18 to the oil seal 6 is also advantageously minimized, thereby making a contribution to improvement in the durability of the O-ring 15 which is of rubber material.

Although in FIG. 3 the depth of the gas chamber 16 is shown to be equal to that of the oil seal groove 12, it need not be limited thereto, but can be determined depending upon the amount of blowby gas which will leak into the space past the side seals 9 and/or the size of the rotor 4.

Figure 4:
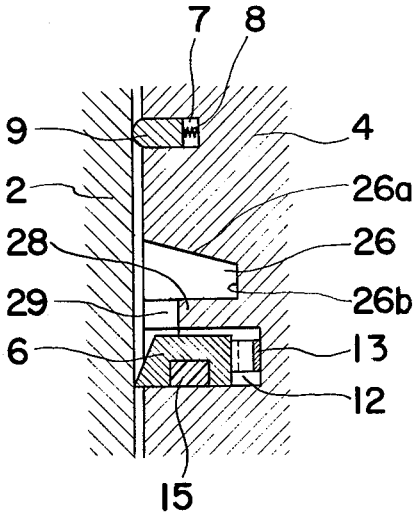
FIG. 4 is a view similar to FIG. 3, but showing another preferred embodiment of the present invention.

In the embodiment shown in FIG. 4, the partition wall 28 between the gas chamber 26 and the oil seal groove 12 terminates flush with the plane of the rotor end face 5. The passage means is, in this embodiment, constituted by a plurality of cutout portions or slots 29 equally spaced from each other around the entire circumference of the annular partition wall 28.

The gas chamber 26 has a radially outer wall surface 26*a* which is outwardly beveled from the bottom 26*b* of the gas chamber 26. This beveled radially outer wall surface 26*a* facilitates the flow of the moisture component of the blowby gas, which is condensed on the rotor end face 5, from the rotor end face 5 into the bottom of the gas chamber 26 along said beveled surface 26*a*. Even though the moisture component of the blowby gas enters the gas chamber 26, it can also readily be removed from the gas chamber 26 together with the gaseous component of the blowby gas into one of the working chambers 20 during the intake stroke. More specifically, when the gaseous component of the blowby gas which has entered the gas chamber 26 is recovered by being drawn into the intake chamber by the effect of the negative pressure in a similar manner as hereinbefore described in connection with the foregoing embodiment, the moisture component of said blowby gas within the gas chamber 26 is removed from said gas chamber 26 under the influence of the centrifugal force developed during the planetary rotation of the rotor 4 so that the moisture component does not enter the space inside of the oil seal 6 past said oil seal 6.

Figure 5:
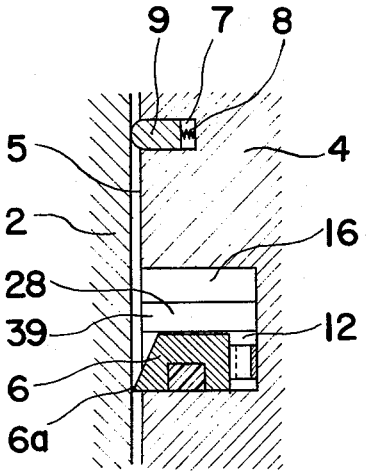
FIG. 5 is a view similar to FIG. 3, showing a cross-section taken along the line V—V in FIG. 6.
Figure 6:
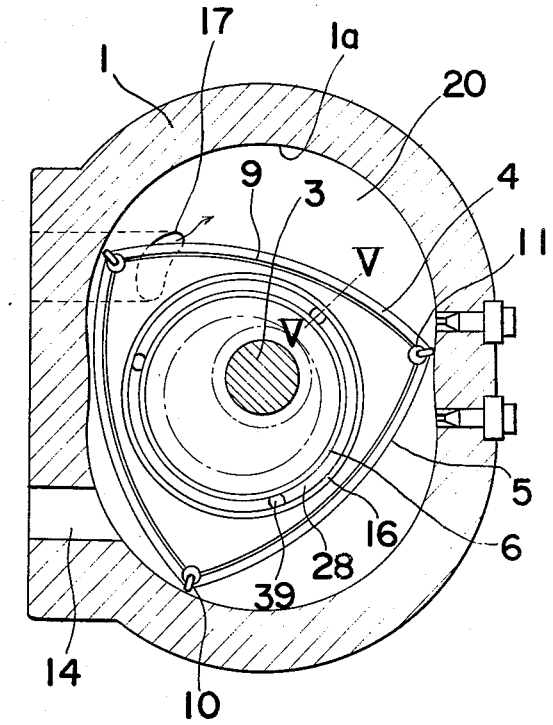
FIG. 6 is a view similar to FIG. 1, illustrating the position of passage means employed in the embodiment of FIG. 5.

The passage means may be constituted by a plurality of deep slots equally spaced from each other around the entire circumference of the partition wall, such as shown in FIGS. 5 and 6.

Referring now to FIGS. 5 and 6, the partition wall 28, as best shown in FIG. 5, terminates flush with the rotor end face 5 and the depth of the gas chamber 16 is equal to the depth of the oil seal groove 12. Deep slots 39 forming the passage means for communicating the gas chamber 16 with the oil seal groove 12 are formed in the partition wall 28 at equally spaced intervals around the entire circumference of said partition wall 28 and extend radially outwardly completely through the thickness of the partition wall 28. Each of the deep slots 39 has a size substantially equal to the depth of the gas chamber 16 or the depth of the oil seal groove 12.

In the embodiment shown in FIGS. 5 and 6, since the gas chamber 16 is communicated with the oil seal groove 12 at local areas, the blowby gas which has entered the space past the side seals 9 can effectively be collected within the gas chamber 16 without substantially adversely influencing the oil seal 6 and the bearing elements of the bearing mechanism by which the rotor 4 is mounted on the eccentric shaft 3.

From the foregoing description of the present invention, it has now become clear that the gas chamber is communicated with the oil seal groove through the passage means formed in the partition wall dividing said gas chamber from said oil seal groove. With the construction according to the present invention, the blowby gas which has leaked past the side seals into the space between the rotor end face 5 and the adjacent end wall of the engine housing structure can advantageously and effectively be collected within the gas chamber and the blowby gas not only within the gas chamber, but also within the oil seal groove can be recovered and drawn into the intake chamber through the intake port to which said gas chamber is communicated at any portion thereof during the planetary motion of the rotor. Therefore, the adverse influence which the blowby gas may have on the oil seal and the other engine parts can advantageously be avoided.

This leads to an improvement in the durability of the oil seal which in turn results in the saving of lubricant oil which will otherwise leak from the inside of the oil seal to the outside of the oil seal. In other words, the present invention is also advantageous in that the oil consumption of the rotary piston engine is reduced as compared with that of the conventional rotary piston engines. This will now be demonstrated by way of the graph shown in FIG. 7.

Figure 7:
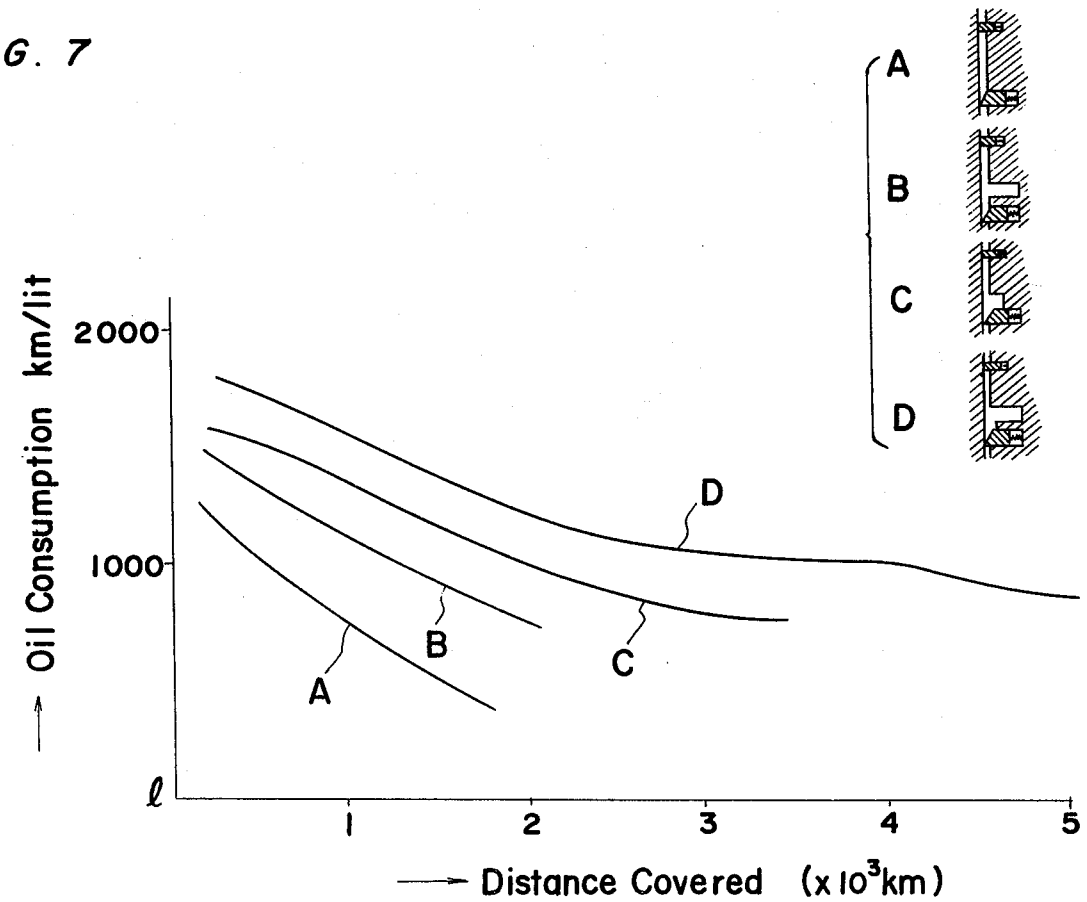
FIG. 7 is a graph illustrating a performance curve of the engine embodying the present invention in comparison with performance curves of the conventional engines of a similar kind.

In the graph of FIG. 7, the abscissa represents the oil consumption while the ordinate represents the distance covered by respective vehicles, one of which vehicles is powered by the rotary piston engine according to the embodiment of FIGS. 1 to 3 of the present invention while the other three are powered by the conventional rotary piston engine, all of these engines being operated at various conditions including idling, acceleration, deceleration and constant drive. It is to be noted that the respective performance curves A, B, C and D are exhibited by the rotary piston engines A, B, C and D of a construction briefly described below.

Engine A: The rotor has neither gas chamber nor the passage means for communicating the gas chamber to the oil seal groove.

Engine B: The rotor has a gas chamber of a depth equal to the depth of the oil seal groove, but has no passage means.

Engine C: The rotor has the gas chamber, but has no partition wall which separates the gas chamber from the oil seal groove.

Engine D: According to the embodiment of FIGS. 1 to 3 of the present invention.

From the graph of FIG. 7, it is clear that, at 1,000 km/lit. of oil consumption, the rotary piston engine embodying the present invention allows a vehicle to run a distance of approximately 4,000 km, while with the conventional engines the respective vehicles run a distance of less than 2,000 km. In other words, while the conventional engines require a relatively large amount of oil to be consumed, the engine according to the present invention achieves reduction in the oil consumption.

From the full description of the present invention and/or with reference to the accompanying drawings, various changes and modifications will be apparent to those skilled in the art. By way of example, in all of the foregoing embodiments of the present invention, the gas groove means has been described as constituted by the gas chamber formed in coaxial relation to the center of the rotor end face and also to the oil seal groove. However, the gas chamber need not always be annular in shape, but may be formed in any shape other than the annular shape, for example, in such a shape as to extend in parallel relation to the side seal grooves. In addition, the concept of the present is equally applicable to a rotary piston engine having a fuel injection system.

Accordingly, such changes and modifications are to be understood as included within the true scope of the present invention unless they depart therefrom.

What is claimed is:

1. In an internal combustion type rotary piston engine having a four cycle operation combustion process, said engine having a housing structure with a peripheral wall having a trochoical inner surface and a pair of end walls secured to the opposite ends of said peripheral wall, a rotor eccentrically rotatably mounted within said housing structure and including apex portions held in sliding engagement with the trochoidal inner surface, each end face of the rotor having at least one set of side seal grooves therein adjacent the outer periphery of said rotor, each end face of said rotor having at least one oil seal groove therein inside said side seal grooves, side seal means operatively accommodated in said side seal grooves, an oil seal means operatively accommodated in said oil seal grooves, spring means between said oil seal means and the bottom of said oil seal groove, at least one of said end walls having intake port means therein, and the housing structure having exhaust port means therein, the improvement which comprises;

endless gas groove means in the end face of the rotor between said side seal groove and said oil seal groove;

a partition wall separating said gas groove means from said oil seal groove; and passage means in said partition wall and communicating said gas groove means with said oil seal groove.

2. The improvement as claimed in claim 1, wherein the partition wall terminates axially inwardly of the plane of the rotor end face to leave an annular cutout portion constituting said passage means.

3. The improvement as claimed in claim 1, wherein said gas groove means is an annular groove defined in said end face of the rotor.

4. The improvement as claimed in claim 3, wherein the partition wall terminates axially inwardly of the plane of the rotor end face to leave an annular cutout portion constituting said passage means.

5. The improvement as claimed in claim 3, wherein said annular groove is coaxial with said oil seal groove.

6. The improvement as claimed in claim 3, wherein the radially outer wall surface of said annular groove remote from said oil seal groove is outwardly beveled.

7. The improvement as claimed in claim 3, wherein the partition wall terminates flush with the rotor end face and said partition wall has a plurality of slots therein adjacent the free end of said partition wall, each of said slots extending completely through the thickness of said partition wall and extending radially outwardly from said oil seal groove to said annular groove and together constituting said passage means.

8. The improvement as claimed in claim 7, wherein the slots have a dimension parallel to the rotor axis which is less than the corresponding dimension of the partition wall.

9. The improvement as claimed in claim 7, wherein the slots have a dimension parallel to the rotor axis which is equal to the corresponding dimension of the partition wall.

10. The improvement as claimed in claim 7, wherein the radially outer wall surface of said annular groove remote from said oil seal groove is outwardly beveled.

11. The improvement as claimed in claim 10, wherein the depth of said annular groove is smaller than the depth of said oil seal groove.

12. The improvement as claimed in claim 1, wherein the partition wall terminates flush with the rotor end face and said partition wall has a plurality of slots therein adjacent the free end of said partition wall, each of said slots extending completely through the thickness of said partition wall and extending radially outwardly from said oil seal groove to said annular groove and together constituting said passage means.

13. An improvement as claimed in claim 12, wherein the slots have a dimension parallel to the rotor axis which is less than the corresponding dimension of the partition wall.

14. The improvement as claimed in claim 12, wherein the slots have a dimension parallel to the rotor axis which is equal to the corresponding dimension of the partition wall.

* * * * *